US009013955B2

(12) United States Patent
Zhao

(10) Patent No.: US 9,013,955 B2
(45) Date of Patent: Apr. 21, 2015

(54) METHOD AND APPARATUS FOR ECHO-PEAK DETECTION FOR CIRCUMFERENTIAL BOREHOLE IMAGE LOGGING

(75) Inventor: Jinsong Zhao, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 966 days.

(21) Appl. No.: 12/268,141

(22) Filed: Nov. 10, 2008

(65) Prior Publication Data

US 2010/0118649 A1 May 13, 2010

(51) Int. Cl.
*G01V 1/40* (2006.01)
*E21B 47/00* (2012.01)

(52) U.S. Cl.
CPC ..... *E21B 47/0005* (2013.01)

(58) Field of Classification Search
CPC ..... E21B 47/0005
USPC ..... 181/105; 324/303; 367/25, 32, 35, 43, 367/48; 382/128, 254, 276; 702/6, 7; 703/10
See application file for complete search history.

(56) References Cited

U.S. PATENT DOCUMENTS

| | | | | |
|---|---|---|---|---|
| 4,255,798 | A * | 3/1981 | Havira | 367/35 |
| 4,703,427 | A * | 10/1987 | Catala et al. | 702/12 |
| 4,893,286 | A * | 1/1990 | Cobb | 367/87 |
| 4,928,269 | A | 5/1990 | Kimball et al. | |
| 5,216,638 | A | 6/1993 | Wright | |
| 5,644,550 | A | 7/1997 | Priest | |
| 5,831,934 | A * | 11/1998 | Gill et al. | 367/25 |
| 6,366,531 | B1 | 4/2002 | Varsamis et al. | |
| 6,712,138 | B2 * | 3/2004 | Mandal | 166/250.01 |
| 7,311,143 | B2 | 12/2007 | Engels et al. | |
| 2004/0071363 | A1 * | 4/2004 | Kouri et al. | 382/276 |
| 2006/0273788 | A1 * | 12/2006 | Georgi et al. | 324/303 |
| 2007/0005251 | A1 | 1/2007 | Chemali et al. | |

* cited by examiner

*Primary Examiner* — Daniel L Murphy
(74) *Attorney, Agent, or Firm* — Chowdhury & Georgakis, P.C.

(57) ABSTRACT

Signals from an acoustic transducer used in a borehole include overlapping, ringing reflections from the casing walls, voids in the cement and the formation. By using the Hilbert transform, an envelope of the signals is determined and individual echoes are detected by using a Gauss-Laplace operator.

19 Claims, 10 Drawing Sheets

METHOD AND APPARATUS FOR ECHO-PEAK DETECTION FOR CIRCUMFERENTIAL BOREHOLE IMAGE LOGGING

FIELD OF THE DISCLOSURE

The present disclosure is related to the field of servicing boreholes with electric wireline tools. More specifically, the present disclosure is related to the use of acoustic pulse-echo imaging tools, and processing data acquired with acoustic imaging tools to determine the quality of cement bonding between the casing of a cased borehole and the earth formation.

BACKGROUND OF THE DISCLOSURE

Acoustic pulse-echo imaging tools are known in the art. The acoustic pulse-echo imaging tool usually comprises a rotating head on which is mounted a piezoelectric element transducer. The transducer periodically emits an acoustic energy pulse on command from a controller circuit in the tool. After emission of the acoustic energy pulse, the transducer can be connected to a receiving circuit, generally located in the tool, for measuring a returning echo of the previously emitted acoustic pulse which is reflected off the borehole wall. By processing the reflected signal, it is possible to infer something about the acoustic impedance characterizing the near-borehole environment. Specifically, changes in acoustic impedance are diagnostic of the quality of cement bonding between casing and the earth formation.

To detect possible defective cement bonds, the received signal has to be processed to estimate the arrival times and amplitudes of a plurality of reflections that may be overlapping in time, varying widely in amplitudes, and highly reverberatory in nature. The present disclosure is directed towards a method which estimates the arrival times and amplitudes of a plurality of reflections under such conditions.

SUMMARY OF THE DISCLOSURE

One embodiment of the disclosure is a method of characterizing a casing installed in a borehole in an earth formation. The method includes activating a transducer at at least one azimuthal orientation in the borehole and generating an acoustic pulse; receiving a signal comprising a plurality of overlapping events resulting from the generation of the acoustic pulse; estimating an envelope of the received signal; and estimating from the envelope of the received signals an arrival time of each of the plurality of events, the arrival times being characteristic of a property of at least one of: (i) the casing, and (ii) a cement in an annulus between the casing and the formation.

Another embodiment of the disclosure is an apparatus for characterizing a casing installed in a borehole in an earth formation. The apparatus includes a transducer configured to generate an acoustic pulse at at least one azimuthal orientation in the borehole; a receiver configured to receive a signal comprising a plurality of overlapping events resulting from the generation of the acoustic pulse; and a processor configured to estimate an envelope of the received signal; and estimate from the envelope of the received signal an arrival time of each of the plurality of events, the arrival times being characteristic of a property of at least one of: (i) the casing, and (ii) a cement in an annulus between the casing and the formation.

Another embodiment of the disclosure is a computer-readable medium accessible to a processor, the computer-readable medium including instructions which enable to processor to characterize a property of a casing in a borehole in an earth formation using a signal comprising a plurality of events resulting from generation of an acoustic pulse by a transducer in the borehole, the instructions including estimation of an envelope of the received signal and estimating from the envelope an arrival time of each of the plurality of events.

BRIEF DESCRIPTION OF THE FIGURES

The present disclosure and its advantages will be better understood by referring to the following detailed description and the attached drawings in which.

DETAILED DESCRIPTION OF THE DISCLOSURE

Figure 1:
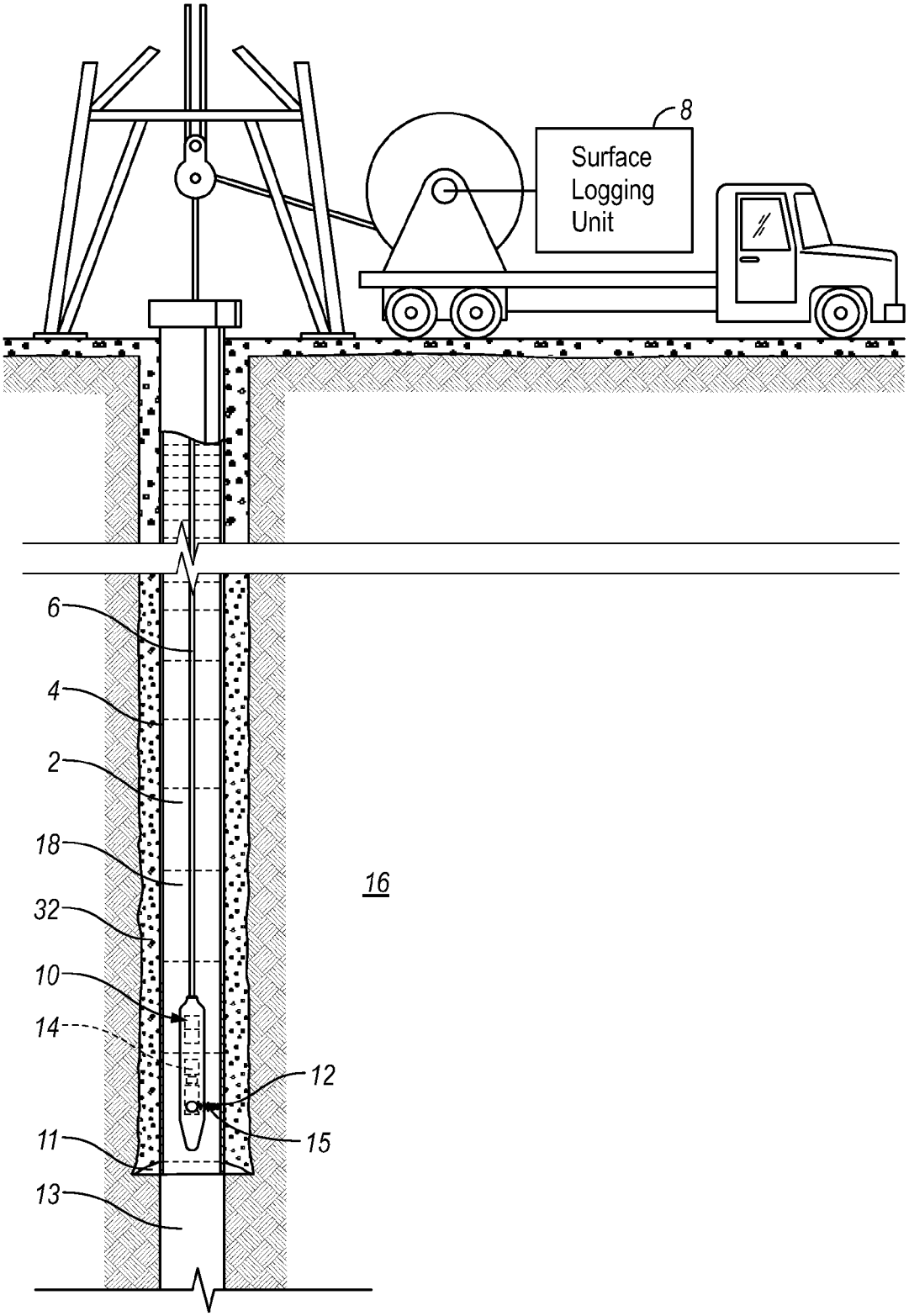
FIG. 1 depicts the acoustic pulse-echo imaging tool deployed within a borehole.

FIG. 1 shows an acoustic pulse-echo imaging tool 10 as it is typically used in a borehole 2. The acoustic pulse-echo imaging tool 10, called the tool for brevity, is lowered to a desired depth in the borehole 2 by means of an electric wireline or cable 6. Power to operate the tool 10 is supplied by a surface logging unit 8 connected to the other end of the cable 6. Signals acquired by the tool 10 are transmitted through the cable 6 to the surface logging unit 8 for processing and presentation.

During the process of drilling the borehole 2, a casing 4 is set in the borehole 2 and cemented in place with concrete 32. At the bottom of the casing 4 is a casing shoe 11. Drilling the borehole 2 continues after cementing of the casing 4 until a desired depth is reached. At this time, the tool 10 is typically run in an open-hole 13, which is a portion of the borehole 2 deeper than the casing shoe 11. The tool 10 is usually run in the open-hole 13 for evaluating an earth formation 16 penetrated by the borehole 2. Sometimes evaluation of the earth formation 16 proceeds to a depth shallower than the casing shoe 11, and continues into the part of the borehole 2 in which the casing 4 is cemented.

The tool 10 has a transducer section 14 from which an acoustic pulse 12 is emitted. The acoustic pulse 12 travels through a liquid 18 which fills the borehole 2. The liquid 18 may be water, water-based solution of appropriate chemicals, or drilling mud. When the acoustic pulse 12 strikes the wall of the borehole 2, or the casing 4, at least part of the energy in the acoustic pulse 12 is reflected back toward the tool 10 as a reflection 15. The transducer section 14 is then switched to receive the reflection 15 of the acoustic pulse 12 from the wall of the borehole 2, or from the casing 4. The reflection 15 contains data which are useful in evaluating the earth formation 16 and the casing 2.

Figure 2:
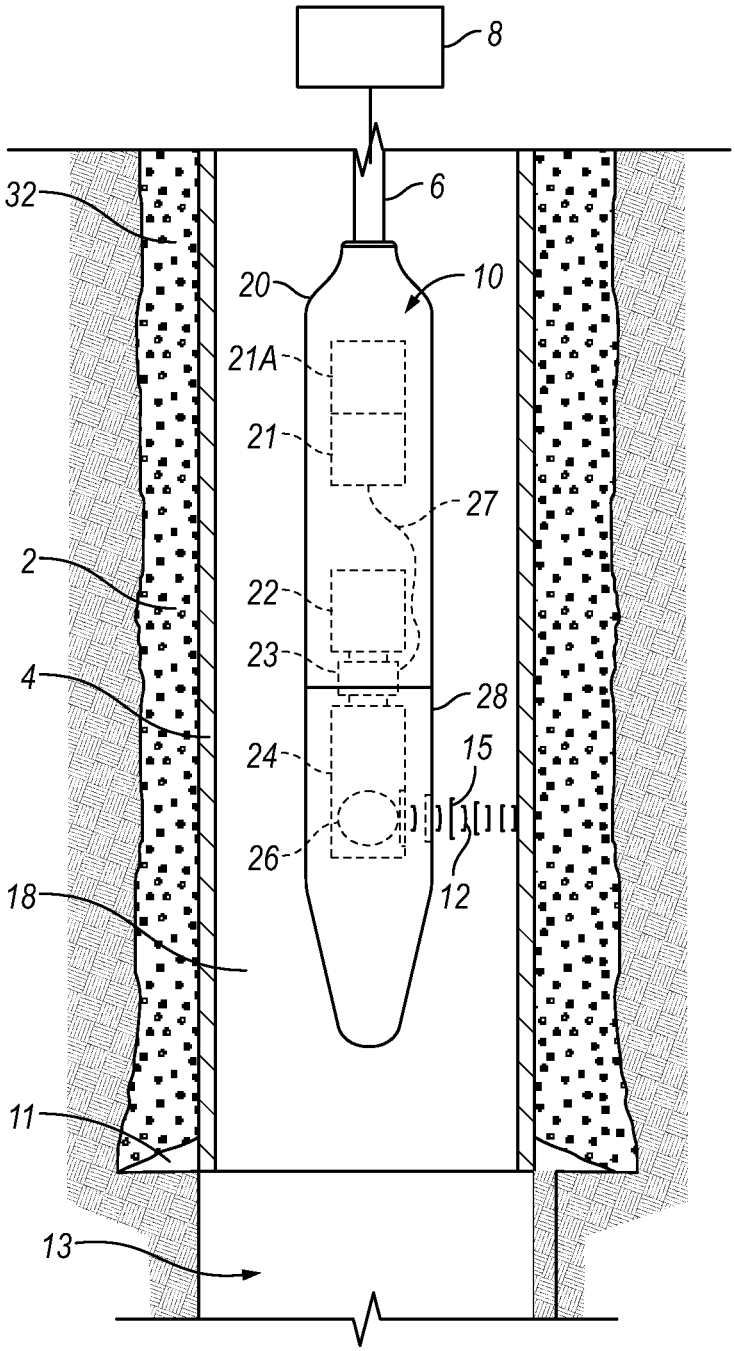
FIG. 2 shows the acoustic pulse-echo imaging tool in more detail.

FIG. 2 shows the tool 10 in more detail. The tool 10 is connected to one end of the cable 6 and comprises a housing 20 which contains a transducer head 24 rotated by an electric motor 22. Rotation of the transducer head 24 enables evaluation of substantially all the circumference of the borehole 2 and casing 4 by enabling acoustic pulses 12 to be aimed at and reflections 15 received from various angular positions around the axis of the borehole 2 or casing 4. The transducer head 24 is located within an acoustically transparent cell 28. The acoustic pulses 12 and the reflections 15 can easily pass through the cell 28. The acoustic pulses 12 are generated, and the reflections 15 are received by a piezoelectric element 26 contained within the transducer head. The piezoelectric element 26 is constructed with an internal focusing feature so that the emitted acoustic pulses 12 have an extremely narrow beam width, typically about ⅓ of an inch. Narrow beam width enables high resolution of small features in the borehole 2. The piezoelectric element 26 emits the acoustic pulses 12 upon being energized by electrical impulses from a transceiver circuit 21. The electrical impulses are conducted through an electromagnetic coupling 23 which enables rotation of the transducer head 24. After transmitting the acoustic pulse 12, the transceiver circuit 21 is programmed to receive a time-varying electrical voltage 27 generated by the piezoelectric element 26 as a result of the reflections 15 striking the piezoelectric element 26. The transceiver circuit 21 also comprises an analog-to-digital converter 21A which converts the resulting time-varying electrical voltage 27 into a plurality of numbers, which may also be known as samples, representing the magnitude of the time-varying electrical voltage 27 sampled at spaced-apart time intervals. The plurality of numbers is transmitted to the surface logging unit 8 through the cable 6.

Figure 3:
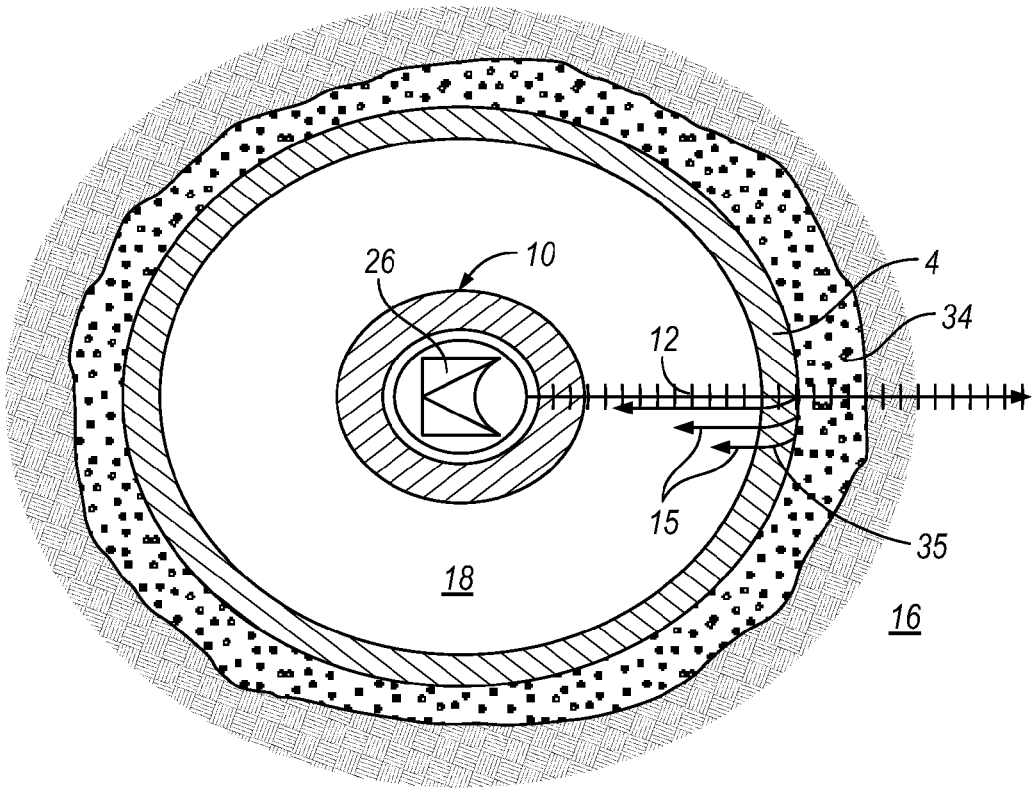
FIG. 3 shows typical acoustic energy travel paths from the tool to the borehole wall and associated reflections.

FIG. 3 shows the principle of operation of the tool 10 in more detail as it relates to determining the thickness of the casing 4. The tool 10 is suspended substantially in the center of the borehole 2. The acoustic pulses 12 emitted by the tool 10 travel through the fluid 18 filling the borehole until they contact the casing. Because the acoustic velocity of the casing 4 and the fluid 18 are generally quite different, an acoustic impedance boundary is created at the interface between the casing 4 and the fluid 18. Some of the energy in the acoustic pulse 12 will be reflected back toward the tool 10. Some of the energy of the acoustic pulse 12 will travel through the casing 4 until it reaches the interface between the casing 4 and cement 34 in the annular space between the borehole 2 and the casing 4. The acoustic velocity of the cement 34 and the acoustic velocity of the casing 4 are generally different, so another acoustic impedance boundary is created. As at the fluid casing interface, some of the energy of the acoustic pulse 12 is reflected back towards the tool 10, and some of the energy travels through the cement 34. Energy reflected back towards the tool 10 from the exterior surface of the casing 4 will undergo a further partial reflection 35 when it reaches the interface between the fluid 18 in the borehole 2 and the casing 4.

Figure 4A:
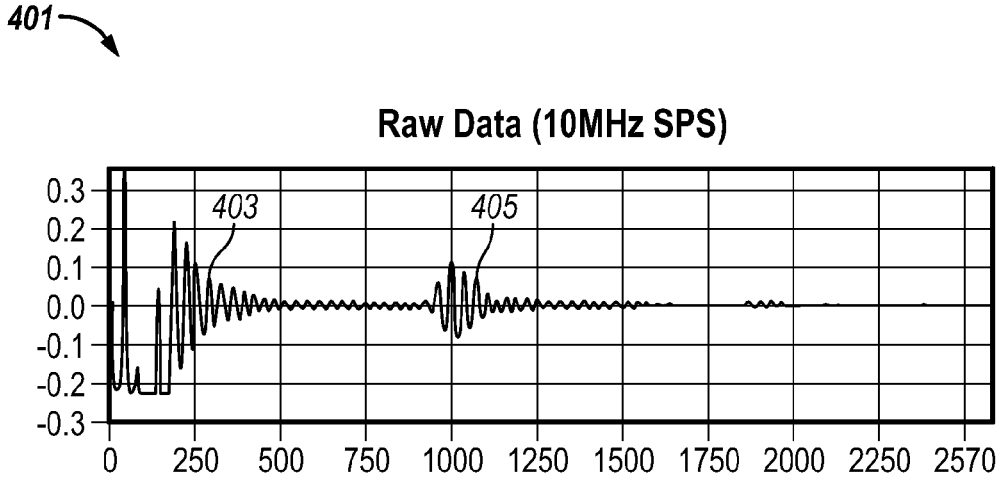
FIGS. 4(*a*)-4(*c*) show three examples of a reflected signal that includes an echo signal at different times after a primary echo.
Figure 4B:
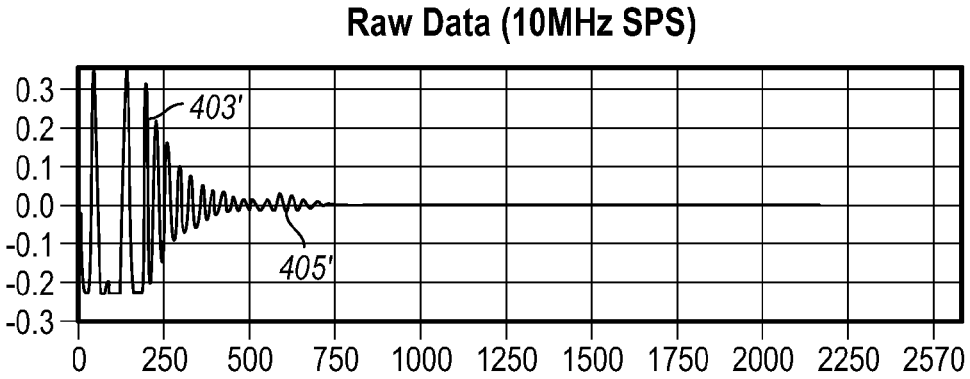
Figure 4C:
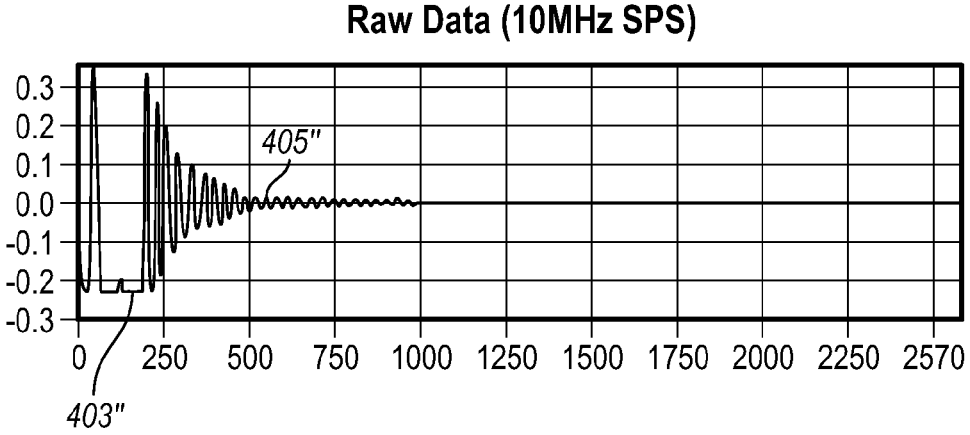

FIG. 4 shows three exemplary types of reflection signals 401 that may be received. FIG. 4(*a*) shows two reflections 403, 405 that are clearly separate and distinguishable. Reflection 405 may be, for example, a reflection from the cement-formation interface, while 403 may be a signal from the casing-cement interface. Other scenarios are possible, such as reflection 405 being a reflection from a void space within the cement while reflection 403 is a reverbatory signal from the inner and outer walls of the casing. For the purposes of the present disclosure, the reflections 405, 405' and 405" are referred to as secondary signals or echos, while the signals 403, 403' and 403" are referred to as primary signals. The present disclosure addresses two problems. The first problem is that of estimating the characteristics of an echo such as 405 that has a ringing character when it is clearly separate from the primary signal. Those versed in the art and having benefit of the present disclosure will recognize that the ringing character of the secondary signal 405 results from the piezoelectric source 26 that is used to generate the signal in the tool 10. The second problem addressed in the present disclosure is that of identifying the arrival of the secondary signal when it may be separate from the primary signal, as in FIG. 4(*a*), or is not separate from the primary signal as in FIGS. 4(*b*) and 4(*c*).

One point to note about the echo signal is that it looks like a wavelet having an unknown envelope function, a known center frequency, and an approximately known bandwidth. The first problem can then be characterized as that of estimating the envelope of the wavelet, while the second problem can be characterized as that of detecting the time of arrival of the wavelet.

An effective way to estimate the envelope of a wavelet is to use the Hilbert transform. An acoustic signal f(t) such as that in FIG. 4(*a*) can be expressed in terms of a time-dependent amplitude A(t) and a time-dependent phase θ(t) as:

$$f(t)=\mathrm{A}(t)\cos\theta(t) \quad (1).$$

Its quadrature trace f*(t) then is:

$$f^*(t)=\mathrm{A}(t)\sin\theta(t) \quad (2),$$

and the complex trace F(t) is:

$$F(t)=f(t)+jf^*(t)=\mathrm{A}(t)e^{j\theta(t)} \quad (3).$$

If f(t) and f*(t) are known, one can solve for A(t) as $$\mathrm{A}(t)=\lfloor f^2(t)+f^{*2}(t)\rfloor^{1/2}=|F(t)| \quad (4)$$

as the envelope of the signal f(t).

One way to determine the quadrature trace f*(t) is by use of the Hilbert transform:

$$f^*(\tau)=\text{p.v.}\int_{-\infty}^{\infty}\frac{f(t)}{\tau-t}dt, \quad (5)$$

where p.v. represents the principal value. The Hilbert transform needs a band-limited input signal and is sensitive to wide-band noise. Consequently, before applying the Hilbert transform, a band-pass filter is applied. In the present method, a Cauchy filter is used as the band-pass filter.

Figures 5A, 5B:
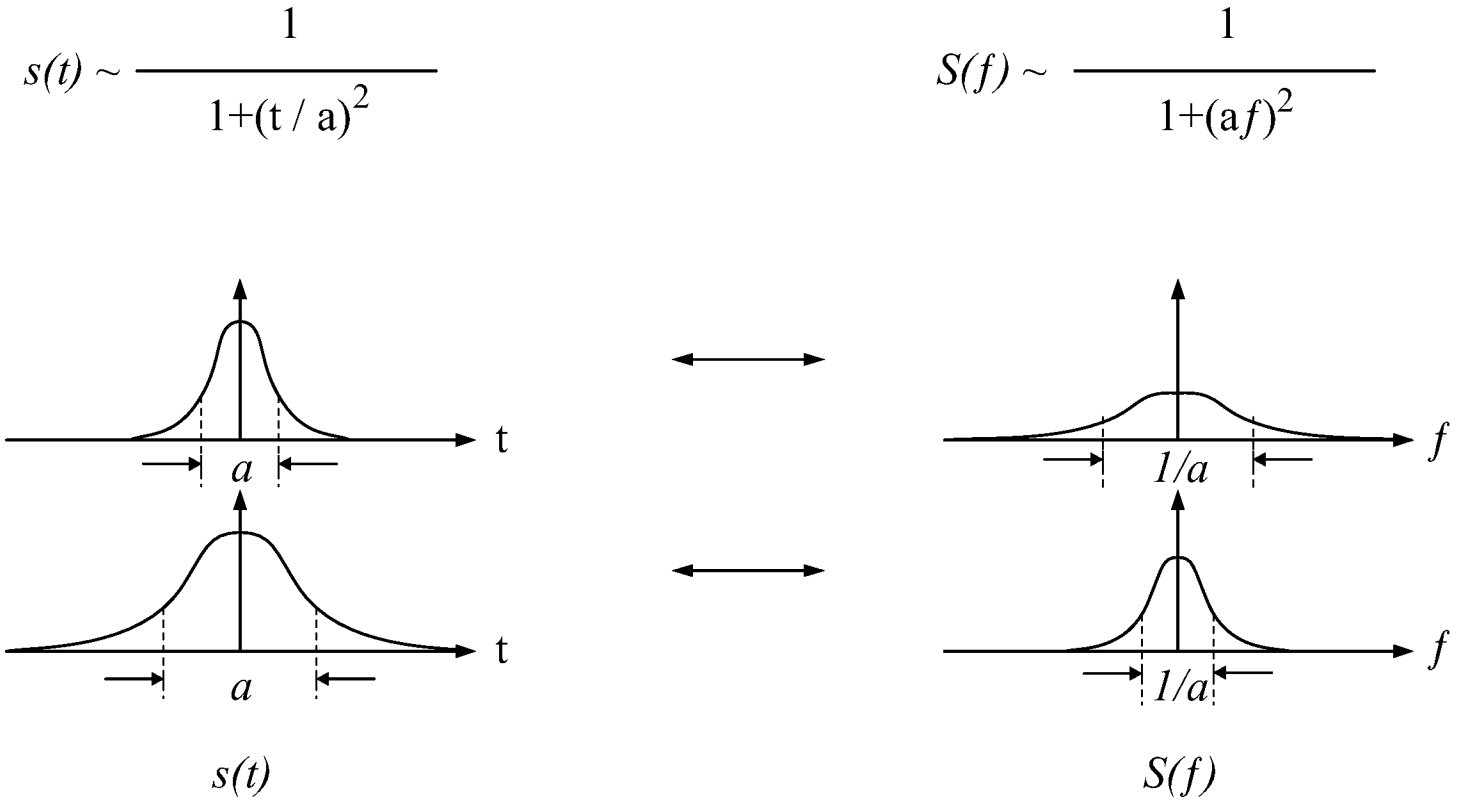
FIGS. 5(*a*)-5(*b*) show time-domain and frequency-domain representations of a Cauchy bandpass filter.

FIGS. 5(*a*), 5(*b*) show representations of two different Cauchy filters in the time domain (FIG. 5(*a*)) and in the frequency domain (FIG. 5(*b*)). The Cauchy filter in the time domain is given by $$s(t)\approx\frac{1}{1+\left(\frac{t}{a}\right)^2}. \quad (6)$$

An advantage of the Cauchy filter that can be seen in FIGS. 5(*a*), 5(*b*) is that there are no ripples in either the time domain or in the frequency domain. Visual inspection of the signal 405 gives its time interval and the number of cycles or loops in the wavelet. Knowing this and the digitization interval, the Cauchy filter can be generated.

Figure 6A:
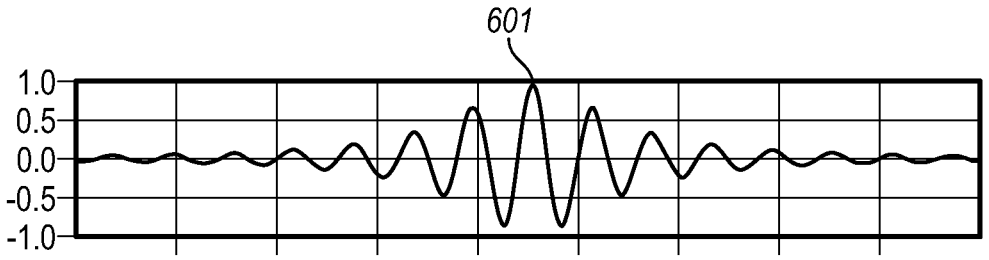
FIGS. 6(*a*)-6(*b*) show the wavelet of FIG. 4(*a*) and the in-phase and quadrature components of its band-limited Hilbert transform.
Figure 6B:
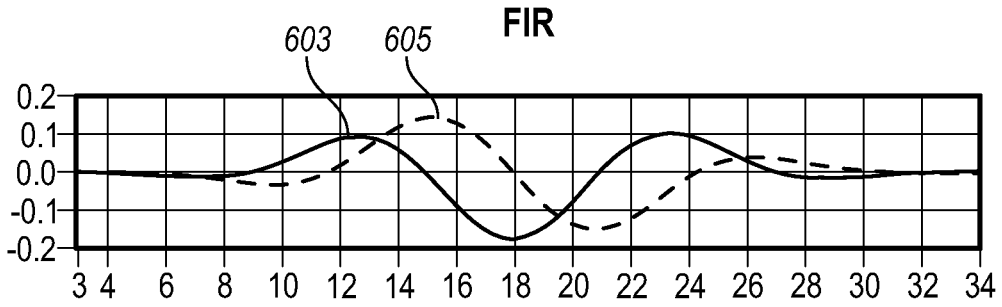

FIG. 6(*a*) shows the wavelet corresponding to signal 405 on an expanded scale. FIG. 6(*a*) shows 100 samples at a sampling rate of 4 MHz and shows approximately 5 to 6 cycles of the wavelet. However, due to limitations on computing capability for downhole applications, in one embodiment of the disclosure the wavelet is truncated. As an example, the truncation may be to 36 samples. A Hanning window is used to reduce the Gibbs phenomenon that results from the truncation.

Commonly, the Hilbert transform is applied in the frequency domain. To reduce the computational burden, in one embodiment of the present disclosure the Cauchy filter is combined with the Hilbert transform and applied to the signal. To speed up the computation, the Cauchy-Hilbert bandpass filter (CHBP filter) is applied in the time domain by convolving the signal separately with the in-phase part of the CHBP filter and the quadrature component of the CHBP filter. FIG. 6(*b*) shows the in-phase 603 and the quadrature 605 components of the CHBP filter.

Figure 7:
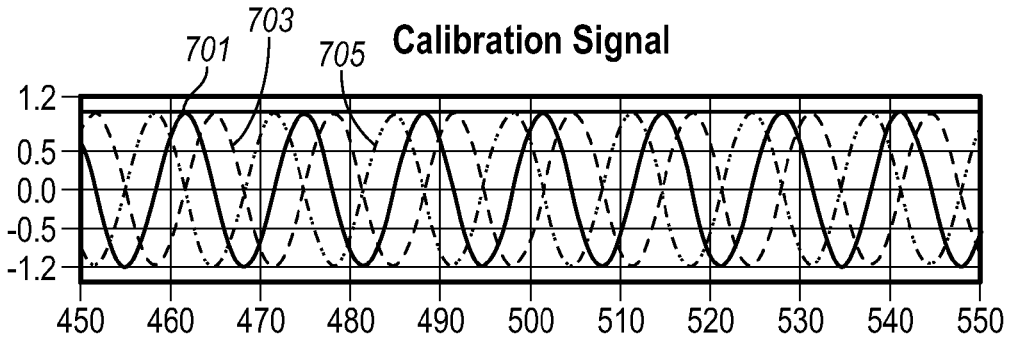
FIG. 7 shows a detail of the application of in-phase and quadrature filters to the reflection signal of FIG. 4(*a*)

Normalization of the gains of the filters is necessary. This process is illustrated in FIG. 7 where 701 is the result of applying the quadrature component filter, 703 is the input signal, and 705 is the result of applying the in-phase part (actually, 180° phase). Using this process, the relative gains of the filters can be adjusted so that the amplitudes of the traces in FIG. 7 are consistent.

Figure 8A:
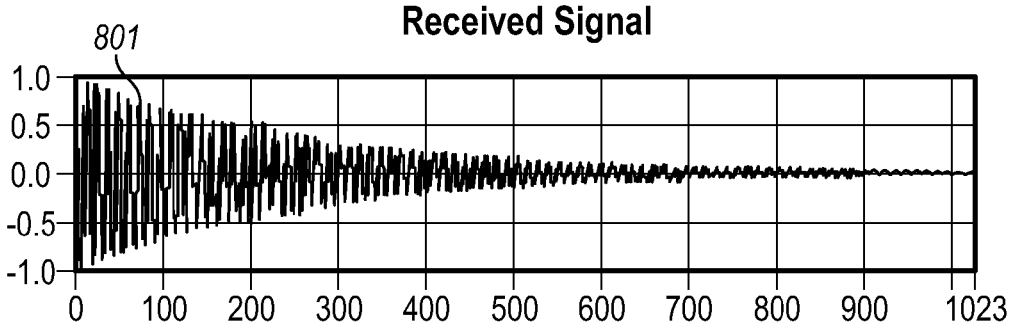
FIGS. 8(*a*)-8(*b*) show the results of applying the envelope detection method to the signal of FIG. 4(*c*)
Figure 8B:
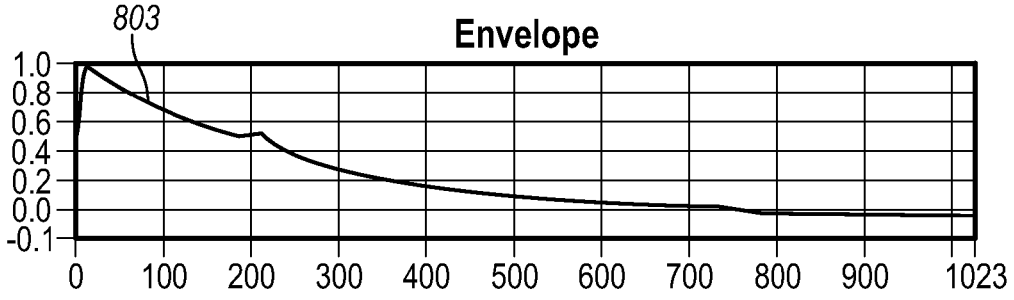

The envelope of the signal in FIG. 4(*c*) was determined using the filters derived above based on the wavelet in FIG. 4(*a*). The result is shown in FIG. 8(*b*) by 803. Those versed in the art and having benefit of the present disclosure will recognize that the envelope curve has some high frequency noise. This noise is a result of improper suppression of the Gibbs phenomenon by the Hanning window. While a small perturbation of the curve 803 is visible at t=200 corresponding to an echo, the perturbation is not a local maximum, so that a peak finding method would not detect this echo. Accordingly, in one embodiment of the disclosure, the first and second moments are removed from the envelope curve using a Laplace Operator. The Laplace operator may be denoted by:

$$\nabla^2 = \frac{d^2}{dt^2}. \tag{7}$$

This filter is very sensitive to high frequency noise, so that a low pass filtering may be applied prior to the Laplace operator. In one embodiment of the disclosure, a Gaussian filter is used, so that the combination of the Gaussian-Laplace operator may be denoted by:

$$\nabla^2 \cdot g(t) = \frac{d^2}{dt^2} e^{-\left(\frac{t}{\tau}\right)^2}. \tag{8}$$

Figure 9A:
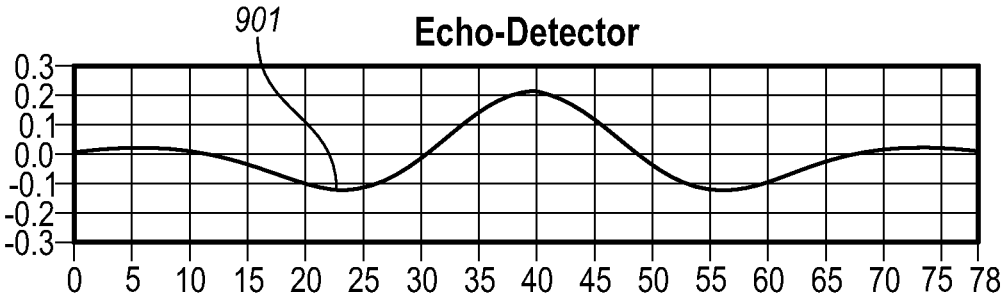
FIGS. 9(*a*)-9(*b*) show an echo detector and the application of it to the data in FIGS. 8(*a*)-8(*b*)
Figure 9B:
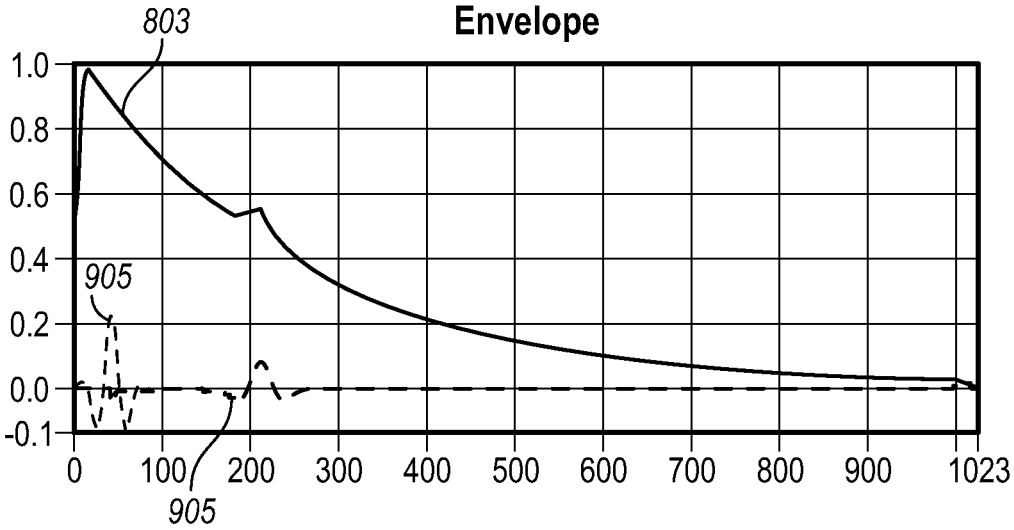

In the example, the wavelet energy packet contains about 5 to 6 cycles (6 cycles with 100 samples for this case). A symmetric filter is needed to preserve phase information. In one embodiment, the filter length is chosen to have 5 cycles with 79 samples. Again a Hanning window function is added on the Gaussian Filter to reduce the Gibbs phenomenon. The result of applying the Gauss-Laplace operator 901 to the data in 803 is shown in FIG. 9(*b*) as echoes 905. Two echoes can be clearly seen. The times of the two echoes give the reflection times.

Figure 10:
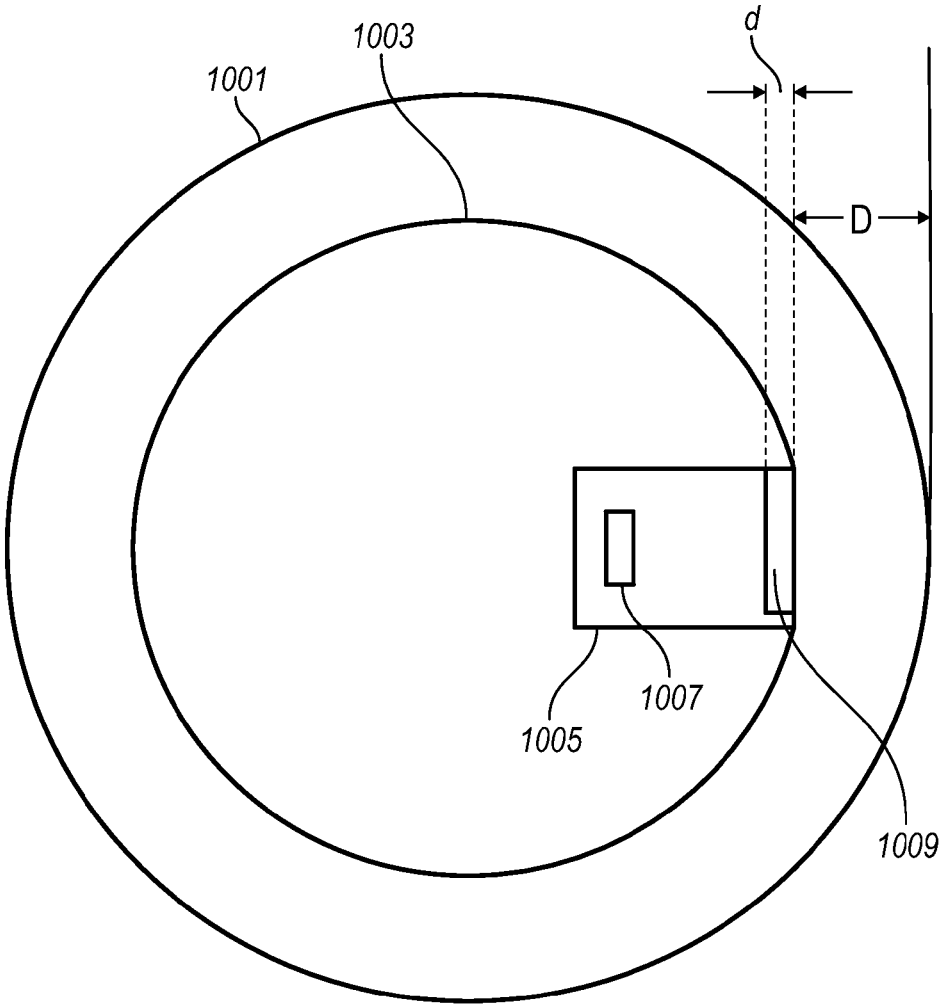
FIG. 10 shows a tool suitable for MWD applications for imaging a borehole wall.

The disclosure above has been for a specific wireline tool used for imaging of borehole walls and for analysis of the quality of cement bond. The principles outlined above may also be used for MWD applications for imaging of borehole walls. Disclosed in FIG. 10 is a cross-section of an acoustic sub that can be used for determining the formation density. The drill collar is denoted by 1003 and the borehole wall by 1001. An acoustic transducer 1007 is positioned inside a cavity 1005. One end of the cavity has a metal plate 1009 with known thickness, compressional wave velocity and density. The cavity is filled with a fluid with known density and compressional wave velocity. Acoustic pulses generated by the transducer 1007 and reflected by the borehole wall 1001 are the desired echo, and reflections from the plate 1009 interfere with the detection of the desired echo. This particular configuration is illustrated in U.S. patent application Ser. No. 11/447,780 of Chemali et al., having the same assignee as the present disclosure and the contents of which are incorporated herein by reference.

No new matter has been added.

The problem of interfering signals is also encountered in U.S. Pat. No. 7,311,143 to Engels et al., having the same assignee as the present disclosure and the contents of which are incorporated herein by reference. Engels discloses a method of and an apparatus for inducing and measuring shear waves within a wellbore casing to facilitate analysis of wellbore casing, cement and formation bonding. An acoustic transducer is provided that is magnetically coupled to the wellbore casing and is comprised of a magnet combined with a coil, where the coil is attached to an electrical current. The acoustic transducer is capable of producing and receiving various waveforms, including compressional waves, shear waves, Rayleigh waves, and Lamb waves as the tool traverses portions of the wellbore casing. The different types of waves travel at different velocities and may thus interfere with each other. In Engels, the received signals may not be echoes, and may simply be different modes propagating at different velocities in the casing in axial and/ or circumferential directions. For the purposes of the present disclosure, the term "arrival" is used to include both echoes and signals propagating in the casing.

Figure 11:
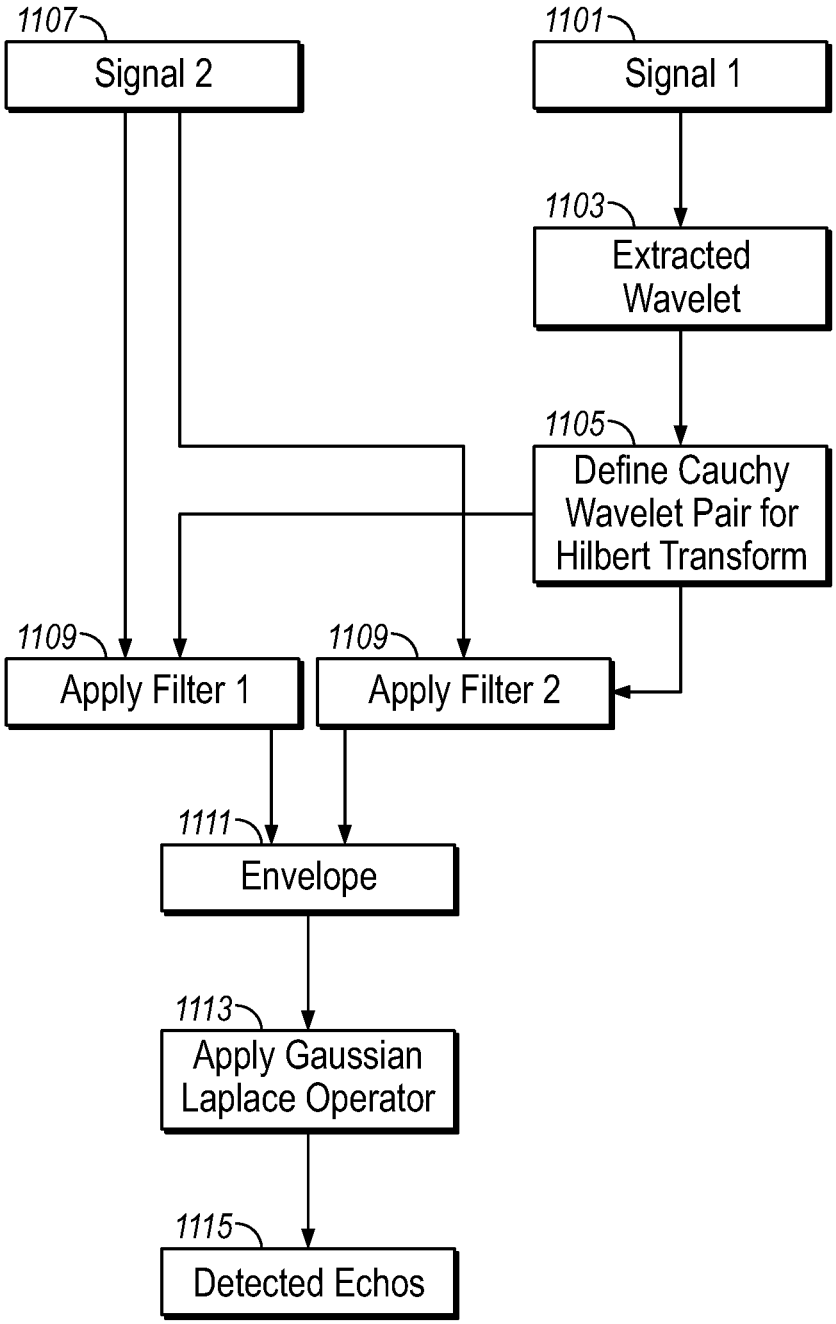
FIG. 11 is a flow chart illustrating some of the steps of the present disclosure.

FIG. 11 is a flow chart that summarizes the method of the present disclosure. Starting with a first signal 1101 in which an arrival is clearly identifiable, a wavelet 1103 is extracted. Based on the characteristics of the wavelet, Cauchy wavelet pairs for the Hilbert transform are defined 1105. The Cauchy wavelet pairs are applied 1109 to a second signal 1107 in which the arrivals are not clearly identifiable, and an envelope is estimated 1111 for the second signal. A Gauss-Laplace operator is applied 1113 to the envelope and individual arrivals are detected 1115.

Based on travel-times and amplitudes of the detected arrivals, using known methods, it is then possible to determine one or more of the following: (i) a thickness of the casing, (ii) the acoustic impedance of the cement in proximity to the casing, (iii) a position and size of a void in the cement, and (iv) a position and size of a defect in the casing.

Implicit in the processing of the data is the use of a computer program implemented on a suitable machine readable medium that enables the processor to perform the control and processing. The machine readable medium may include ROMs, EPROMs, EAROMs, Flash Memories and Optical disks. The determined formation properties may be recorded on a suitable medium and used for subsequent processing upon retrieval of the BHA. The determined formation properties may further be telemetered uphole for display and analysis.

The foregoing description is directed to particular embodiments of the present disclosure for the purpose of illustration and explanation. It will be apparent, however, to one skilled in the art that many modifications and changes to the embodiment set forth above are possible without departing from the scope and the spirit of the disclosure. It is intended that the following claims be interpreted to embrace all such modifications and changes.

What is claimed is:

1. A method of characterizing cement in proximity to a casing installed in a borehole in an earth formation, the method comprising:

activating a transducer at at least one azimuthal orientation in the borehole and generating an acoustic pulse;

receiving a signal comprising a plurality of overlapping events resulting from the generation of the acoustic pulse, at least one of the plurality of overlapping events being due to a ringing of the transducer;

estimating an envelope of the received signal; and estimating from the envelope of the received signal an arrival time of each of the plurality of events by, at least in part, applying a Gaussian Laplace operator to the envelope to estimate arrival times, the arrival times being characteristic of a property of the cement in proximity to the casing, the property being an acoustic impedance of the cement in proximity to the casing.

2. The method of claim 1 further comprising estimating from the envelope an amplitude of each of the events.

3. The method of claim 1 wherein estimating the envelope of the received signal further comprises band passing the received signal and applying a Hilbert transform.

4. The method of claim 3 wherein applying the Hilbert transform further comprises applying a first filter to the received signal and applying a second filter substantially orthogonal to the first filter to the received signal.

5. The method of claim 3 further comprising deriving a bandpass filter using a wavelet extracted from another signal.

6. The method of claim 1 wherein activating the transducer at at least one azimuthal orientation further comprises activating the transducer at a plurality of azimuthal orientations, the method further comprising estimating the property at the plurality of azimuthal orientations.

7. The method of claim 1 wherein the arrival times are also characteristic of a property selected from the group consisting of: (i) a thickness of the casing, (ii) a position and size of a void in the cement, and (iii) a position and size of a defect in the casing.

8. The method of claim 1 further comprising conveying the transducer on a logging tool into the borehole using a wireline.

9. The apparatus of claim 1 further comprising a wireline configured to convey the transducer on a logging tool into the borehole.

10. An apparatus for characterizing cement in proximity to a casing installed in a borehole in an earth formation, the apparatus comprising:

a transducer configured to generate an acoustic pulse at at least one azimuthal orientation in the borehole;

a receiver configured to receive a signal comprising a plurality of overlapping events resulting from the generation of the acoustic pulse, at least one of the plurality of overlapping events being due to a ringing of the transducer; and a processor configured to:

estimate an envelope of the received signal; and estimate from the envelope of the received signal an arrival time of each of the plurality of events by, at least in part, applying a Gaussian Laplace operator to the envelope to estimate arrival times, the arrival times being characteristic of a property of the cement in proximity to the casing, the property being an acoustic impedance of the cement in proximity to the casing.

11. The apparatus of claim 10 wherein the receiver is part of the transducer.

12. The apparatus of claim 10 wherein the processor is further configured to estimate from the envelope an amplitude of each of the plurality of events.

13. The apparatus of claim 10 wherein the processor is further configured to estimate the envelope of the received signal by performing a band passing of the received signal and applying a Hilbert transform.

14. The apparatus of claim 13 wherein the processor is further configured to apply the Hilbert transform by applying a first filter to the received signal and applying a second filter substantially orthogonal to the first filter to the received signal.

15. The apparatus of claim 13 wherein the processor is further configured to derive a bandpass filter using a wavelet extracted from another signal.

16. The apparatus of claim 10 wherein the transducer is configured to generate acoustic pulses at a plurality of azimuthal orientations, and wherein the processor is further configured to estimate the property at the plurality of azimuthal orientations.

17. The apparatus of claim 10 wherein the arrival times also are characteristic of a property selected from the group consisting of: (i) a thickness of the casing, (ii) a position and size of a void in the cement, and (iii) a position and size of a defect in the casing.

18. A non-transitory computer-readable medium including instructions stored thereon which enable a processor to characterize an acoustic impedance of cement in proximity to casing in a borehole in an earth formation using a received signal comprising a plurality of events resulting from generation of an acoustic pulse by a transducer in the borehole, at least one of the plurality of events being due to a ringing of the transducer, the instructions enabling the processor to estimate an envelope of the received signal and to estimate from the envelope an arrival time of each of the plurality of events by, at least in part, applying a Gaussian Laplace operator to the envelope to estimate arrival times.

19. The non-transitory computer-readable medium of claim 18 further comprising at least one of: (i) a ROM, (ii) an EPROM, (iii) an EAROM, (iv) a flash memory, and (v) an optical disk.

* * * * *